US007789274B2

(12) United States Patent
Garcia

(10) Patent No.: US 7,789,274 B2
(45) Date of Patent: Sep. 7, 2010

(54) FLUID DISPENSER MEMBER

(75) Inventor: Firmin Garcia, Evreux (FR)

(73) Assignee: Valois S.A.S, Le Neubourg (FR)

( * ) Notice: Subject to any disclaimer, the term of this patent is extended or adjusted under 35 U.S.C. 154(b) by 1250 days.

(21) Appl. No.: 11/017,694

(22) Filed: Dec. 22, 2004

(65) Prior Publication Data

US 2005/0133534 A1 Jun. 23, 2005

Related U.S. Application Data

(60) Provisional application No. 60/569,621, filed on May 11, 2004.

(30) Foreign Application Priority Data

Dec. 22, 2003 (FR) ..... 03 15193

(51) Int. Cl.
*B65D 88/54* (2006.01)

(52) U.S. Cl. ..... 222/321.7; 222/321.3; 222/321.9; 222/340; 222/383.1; 239/333

(58) Field of Classification Search ..... 222/321.7, 222/341, 321.9, 379–380, 384–385, 383.1, 222/321.2, 321.3, 340; 239/333
See application file for complete search history.

(56) References Cited

U.S. PATENT DOCUMENTS

| | | | | |
|---|---|---|---|---|
| 4,050,613 | A | 9/1977 | Corsette | |
| 4,079,865 | A * | 3/1978 | Kutik | 222/259 |
| 4,111,367 | A * | 9/1978 | Hayes | 239/333 |
| 4,361,255 | A | 11/1982 | Saito et al. | |
| 4,369,900 | A | 1/1983 | Saito et al. | |
| 4,494,680 | A | 1/1985 | Corsette | |
| 5,388,766 | A * | 2/1995 | Buisson | 239/333 |
| 5,938,084 | A * | 8/1999 | Fuchs et al. | 222/321.2 |
| 5,947,340 | A * | 9/1999 | Arnold et al. | 222/321.9 |
| 7,014,069 | B2 * | 3/2006 | Crosnier et al. | 222/321.9 |
| 2002/0047025 | A1 * | 4/2002 | Ray | 222/321.3 |
| 2005/0135951 | A1 | 6/2005 | Garcia et al. | |

FOREIGN PATENT DOCUMENTS

| | | | |
|---|---|---|---|
| DE | 39 28 521 | A1 | 3/1991 |
| FR | 2 742 812 | A1 | 6/1997 |
| GB | 2 004 585 | A | 4/1979 |
| WO | WO 02/96776 | A1 * | 5/2002 |
| WO | WO 03066235 | A1 * | 8/2003 |

OTHER PUBLICATIONS

Search Report for FR 0315194 dated Jul. 23, 2004.

* cited by examiner

*Primary Examiner*—Frederick C. Nicolas
(74) *Attorney, Agent, or Firm*—Sughrue Mion, PLLC

(57) ABSTRACT

A fluid dispenser member having a dispensing wall defining an outside surface and inside surface, the wall being provided with a through dispensing orifice connecting the inside surface to the outside surface. The inside surface forming a leaktight slide cylinder for a piston suitable for moving in leaktight contact inside the cylinder for selectively unmasking the dispensing orifice. The piston forming a wall element of a fluid chamber inside which fluid is selectively put under pressure. The inside surface, at the slide cylinder, forming a fluid swirl system immediately upstream from the dispensing orifice. The dispensing wall is formed by a substantially cylindrical skirt further provided with a guide wall defining an inside surface whose inside diameter is greater than the inside diameter of the slide cylinder.

17 Claims, 7 Drawing Sheets

FLUID DISPENSER MEMBER

CROSS REFERENCE TO RELATED APPLICATION

This application claims the benefit under 35 U.S.C. §119 (e) of U.S. provisional patent application Ser. No. 60/569,621, filed May 11, 2004, and priority under 35 U.S.C. §119 (a)-(d) of French patent application No. FR-03.15193, filed Dec. 22, 2003.

TECHNICAL FIELD

The present invention relates to a fluid dispenser member that is generally designed to be associated with a fluid reservoir so as to constitute therewith a fluid dispenser. It is a dispenser member that is generally actuated manually by means of a user's finger. The fluid is dispensed in the form of a sprayed stream of fine droplets, a continuous trickle, or a dollop of fluid, in particular for viscous fluids, such as cosmetic creams. Such a fluid dispenser member can, in particular, be used in the fields of perfumes, cosmetics, or indeed pharmaceuticals, for dispensing fluids of various viscosities.

The present invention relates more particularly but not exclusively to a type of dispenser member that can be referred to as a "pusher-pump". That name can be explained by the fact that the dispenser member comprises a pusher that not only forms a dispensing orifice but also defines a portion of a fluid chamber inside which fluid is selectively put under pressure. When the dispenser member is a pump, that chamber is a pump chamber. A particularity of such a pusher-pump lies in the fact that an inside surface of the pusher, which surface is substantially cylindrical in general shape, serves as a leaktight slide cylinder for a piston that moves in leaktight contact inside said cylinder, thereby selectively unmasking the dispensing orifice. In general, the piston is a piston of the differential type which moves in response to variation in the pressure of the fluid inside the chamber. The differential piston should be distinguished from the main piston which is caused to move by actuating the pusher. Thus, such a pusher-pump includes a differential piston and a main piston, which pistons can move in leaktight contact in respective cylinders. The main cylinder for the main piston can also be formed by the pusher.

BACKGROUND OF THE INVENTION

That applies in particular in the pump described in Document WO 97/23304. The pusher has a push wall on which pressure is exerted by means of a finger for the purpose of actuating the pusher. In addition, the pusher has a skirt that extends downwards from the push wall. Said skirt forms a first leaktight slide cylinder for a differential piston and a main second cylinder for the main piston of the pump. The differential piston is dissociated from the main piston. The differential piston is urged away from the push wall by a spring that serves both as a return spring and as a precompression spring. The slide cylinder for the differential piston is provided with an outlet duct that leads to a nozzle received in a recess formed in the skirt of the pusher. The nozzle forms a dispensing orifice via which the fluid is discharged from the dispenser member. In addition, the recess formed by the skirt is provided with a swirl system which co-operates with the nozzle to entrain the fluid in a swirling movement before it is discharged through the dispensing orifice. The swirl system is conventionally made up of one or more tangential swirl channels opening out into a swirl chamber accurately centered on the dispensing orifice. The swirl system is in the form of a network recessed into the recess in the skirt. The recessed network is then associated with the separate nozzle that comes to isolate the swirl channels and the chamber. Thus, the slide cylinder of the differential piston is in the form of a cylindrical surface interrupted only at the outlet channel. When the pusher is pressed, the main piston rises up inside the main cylinder of the pusher, thereby causing the differential piston to move by sliding in leaktight manner inside the differential cylinder. That causes the spring to be compressed: the differential piston then moves upwards towards the push wall of the pusher. The active sealing lip of the differential piston, which lip is directly in contact with the fluid, slides in the bottom portion of the cylinder that is situated below the outlet channel. As soon as the differential piston reaches the outlet duct, the fluid put under pressure in the chamber is delivered from the chamber through said duct and reaches the nozzle, where it is swirled and discharged through the dispensing orifice.

The pump of Document WO 97/23304 is made up of five essential component elements, namely a body designed to be associated with a fluid reservoir, the pusher, a ball forming an inlet valve member, the differential piston, and the nozzle. The body forms the main piston.

U.S. Pat. No. 4,050,613 describes a pump comprising a pusher and a differential piston which slides within the pusher. The inner wall of the pusher thus forms a slide cylinder. This cylinder is provided with a swirl system which forms a recess in the inner wall of the pusher. Upon sliding in the cylinder, the differential piston unmasks the swirl system. The cylinder is perfectly cylindrical throughout its height and has a constant diameter. The molding step of the swirl system is therefore complicated, because the core used to form the swirl system has to be removed from the cylinder without damaging the cylinder.

SUMMARY OF THE INVENTION

An object of the present invention is to overcome this molding problem of swirl system.

To this end, the present invention provides a fluid dispenser member having a dispensing wall defining an outside surface and inside surface, said wall being provided with a through dispensing orifice connecting the inside surface to the outside surface, the inside surface forming a leaktight slide cylinder for a piston suitable for moving in leaktight contact inside said cylinder for selectively unmasking the dispensing orifice, said piston forming a wall element of a fluid chamber inside which fluid is selectively put under pressure; said fluid dispenser member being characterized in that, at the slide cylinder, the inside surface forms a fluid swirl system immediately upstream from the dispensing orifice, the dispensing wall being formed by a substantially cylindrical skirt further provided with a guide wall defining an inside surface whose inside diameter is greater than the inside diameter of the slide cylinder. This characteristic is particularly advantageous for molding the dispensing wall. The dispensing wall is generally made of an injection-molded plastics material. For this purpose, a mold is used that is made up of a plurality of elements. One of said elements forms in particular a core for forming the inside surface of the dispensing wall. In the present invention, said core must form not only the slide cylinder, but also the swirl system. Since the swirl system extends by forming a portion that is recessed into the slide cylinder, the core must form a corresponding imprint that projects outwards. Thus, while the core is being withdrawn, during unmolding, the projecting imprint must be withdrawn by force. The projecting imprint must therefore come out of the recessed portion that it has formed, and must move along an axial extent of the slide cylinder. Given that the plastics material can creep, forcing the projecting imprint through marks the slide cylinder only very little. Thus, by providing a guide wall with an inside surface having a diameter greater than the inside diameter of the slide cylinder, the projecting imprint of the core can be withdrawn past it without biting into the inside surface of the guide wall. As a result, the projecting imprint of the core is withdrawn under force over only a small axial extent of the slide cylinder: the risks of the slide cylinder being damaged during removal of the molding core are thus limited.

In addition, the fact that the guide wall has an inside diameter greater than the inside diameter of the slide cylinder also makes it easier to put the differential piston in place inside the cylinder without it having to rub against the guide wall.

This type of dispenser may be a pump of the pusher-pump type, but it may also be any other type of dispenser member in which the pusher is dissociated from the dispensing wall. It is possible, in particular, to make provision for the dispensing wall to be fixed relative to the reservoir, or else mounted to move relative to the pusher. Advantageously, the slide cylinder, the dispensing orifice and the swirl system are formed integrally with the dispensing wall.

In another embodiment, the dispensing wall is formed by a pusher having a push wall which is extended at its outer periphery by the dispensing wall. Advantageously, the piston is urged resiliently against the push wall, and can be moved away from said push wall in order to unmask the dispensing orifice. This characteristic is also advantageous in combination with a guide wall whose inside diameter is greater than the inside diameter of the slide cylinder. Although the piston moves inside the top portion of the slide cylinder adjacent to the push wall, it avoids the bottom portion of the cylinder which might be damaged by the projecting imprint of the core that has formed the swirl system being withdrawn.

According to another characteristic, the piston is urged resiliently away from the guide wall and can be moved towards said guide wall. In which case, the piston must move over the bottom portion of the slide cylinder which might be damaged by the projecting imprint of the molding core.

In other aspects, the piston is urged resiliently away from the push wall and can be moved towards said push wall. Here too, the piston moves over the portion of the cylinder through which the projecting imprint of the molding core has passed.

According to another advantageous characteristic, the push wall is provided with an inside surface which forms a wall element of the chamber. This applies in particular when the piston moves away from the push wall against a return spring.

In another aspect, the piston is a differential piston which moves in response to variation in the pressure in the chamber, said differential piston having at least one sealing lip in leaktight sliding contact with the slide cylinder. Advantageously, the differential piston is integral with or secured to a main piston in leaktight sliding contact in a main cylinder. This applies in particular when the pump is of the cap-pump type.

In another aspect, the dispenser member has a body serving to be associated with a fluid reservoir, said body forming a main cylinder in which a main piston slides. In another practical aspect, the dispensing wall is formed by a substantially cylindrical skirt which further forms a guide wall defining an inside surface forming a main cylinder for a main piston.

Advantageously, the swirl system comprises at least one swirl channel and a swirl chamber centered on the dispensing orifice and optionally a peripheral feed ring. This is a conventional design for a swirl system.

An advantageous aspect of the invention lies in the fact that the wall through which a dispensing orifice passes also internally forms a fluid swirl system. Advantageously, the inside surface forms a slide cylinder for an advantageously differential piston.

BRIEF DESCRIPTION OF THE DRAWINGS

The invention is described more fully below with reference to the accompanying drawings which show embodiments of the invention by way of non-limiting example.

In the figures.

DETAILED DESCRIPTION OF THE INVENTION

Figure 1:
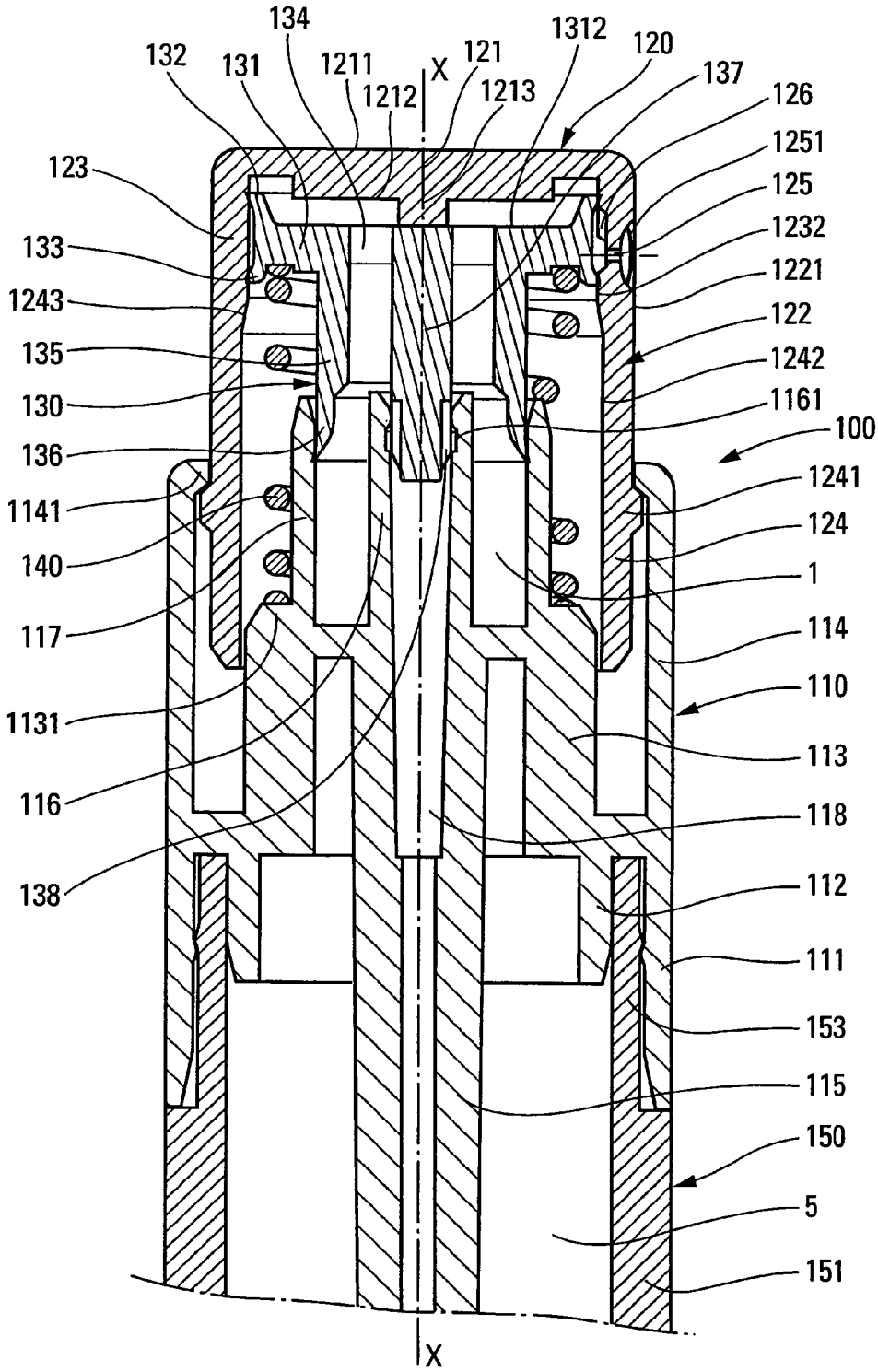
FIG. 1 is a vertical section view through a first embodiment of the dispenser member in the rest state, associated with a fluid reservoir that is shown merely in part.
Figure 2:
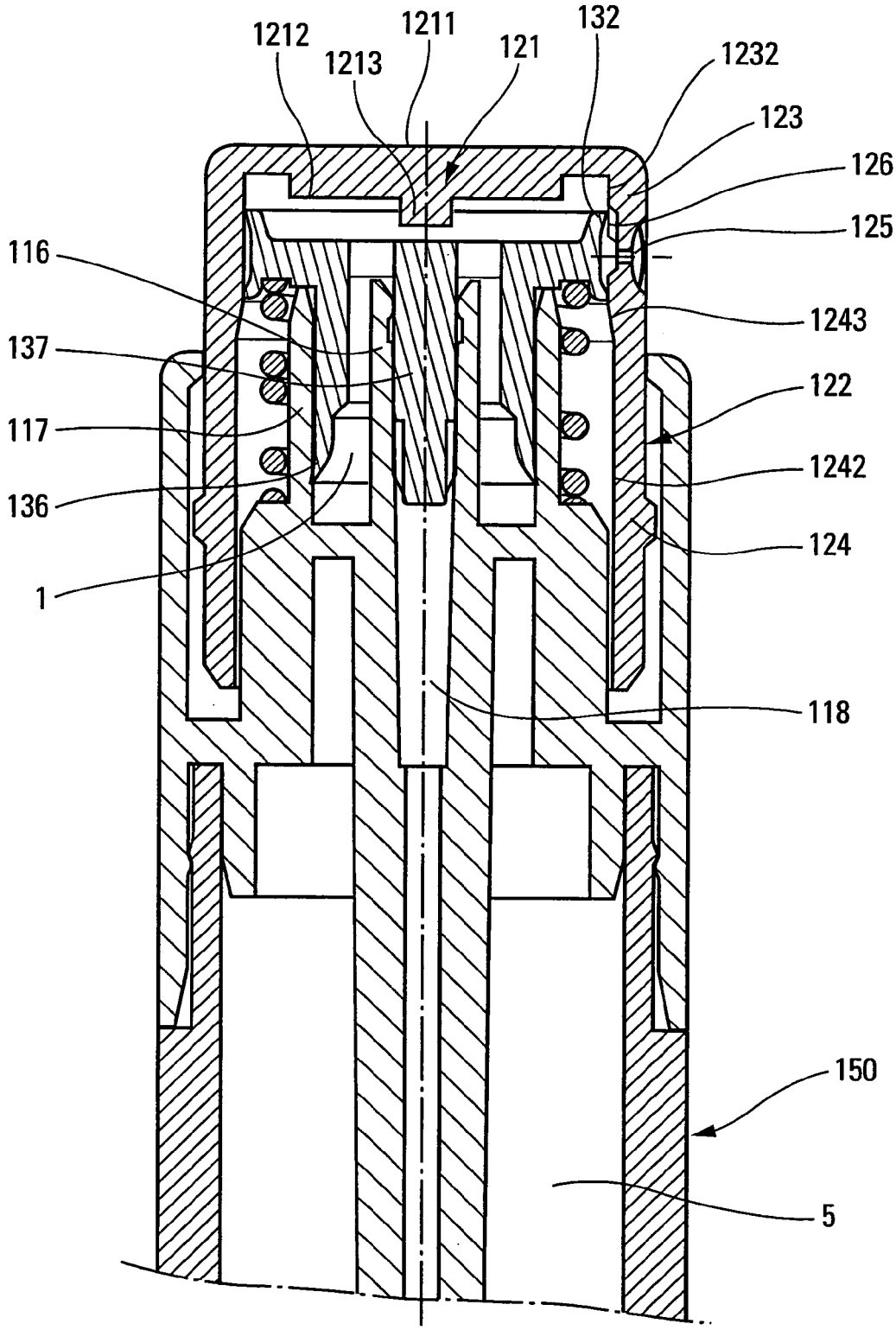
FIG. 2 is a view similar to FIG. 1, in the actuated position.

The dispenser member of the first embodiment shown in FIGS. 1 and 2 is associated with a receptacle 150 having a body 151 internally defining a fluid reservoir 5. At its top end, the body 151 is provided with an opening in the form of a neck 153, which serves for fixing the dispenser member of the invention.

The dispenser member comprises three component elements, namely a body 110, a pusher 120, and a piston member 130. The dispenser member further comprises spring means in the form of a coil spring 140. The body, the pusher, and the piston member are preferably made of molded plastics material. The dispenser member is designed as a pump having a pump chamber 1.

The body 110 is provided with a fixing ring 111 which co-operates with the neck 153 to fix the member to the receptacle 150. The ring 111 is in engagement with the outside of the neck 153. In addition, the body forms a self-sealing lip 112 in leaktight engagement with the inside wall of the neck 153. The body 111 also forms a guide band 114 which can advantageously extend in alignment with the ring 111. The top end of the guide band 114 is provided with an inwardly-extending rim 1114. The body 110 also forms a bushing 113 which extends concentrically inside the guide band 114. Thus, an annular gap is formed between the band 114 and the bushing 113. At its top end, the bushing 113 has a shoulder 1131 which serves as an abutment surface for the spring 140. The bushing 113 is extended upwards by forming a main cylinder 117 which internally defines a leaktight sliding surface whose function is described below. The body also forms a dip tube 115 which extends inside the receptacle 150. At its top end, the dip tube 115 is extended by an inlet sleeve 116 which forms an inlet valve profile or seat 1161. An inlet duct 118 passes through the dip tube 115 and through the sleeve 116. The inlet sleeve 116 extends concentrically inside the main cylinder 117, so that an annular space is formed between them.

The body 110 is axially and circularly symmetrical about an axis X that extends longitudinally at the axial center of the inlet duct 118.

This is a particular design for a particular body of a dispenser member in a first embodiment of the invention. Naturally, the body can have characteristics other than the above-described characteristics without going beyond the ambit of the invention.

The pusher 120 forms a dispenser head for the dispenser member. The pusher 120 comprises a push wall 121 and a peripheral skirt 122 which extends downwards from the outer periphery of the push wall. Thus, the pusher 120 is in the general shape of an upside-down cup for which the push wall forms the end-wall and the skirt forms the cylindrical side wall. However, the skirt is not necessarily cylindrical in shape. It can be frustoconical or rounded in section.

The push wall 121 has a push outside surface 1211 on which it is possible to push with one or more fingers. In addition, the push wall 121 has an inside surface 1212 which advantageously forms an abutment stud 1213.

The skirt 122 has a dispensing top wall 123 and a guide bottom wall 124. At its top end, the dispensing wall 123 is connected to the outer periphery of the push wall 121. The dispensing wall 123 has an outside surface 1221 and an inside surface 1232. The inside surface 1232 is preferably circularly cylindrical and defines a slide cylinder as explained below. In addition, the dispensing wall 123 is provided with a through dispensing orifice 125 which extends from the inside surface to the outside surface. The dispensing orifice 125 can open out into a dispensing dish 1251 on the outside surface.

According to an advantageous characteristic of the invention, the inside wall 1232 of the dispensing wall 123 is provided with a swirl system 126 which makes it possible to rotate fluid in the form of a swirl whose eye is centered on the dispensing orifice. Thus, the dispensing wall 123, which is advantageously formed integrally with the push wall 121 and with the guide wall 124, is provided with a through dispensing orifice and has an inside surface provided with a swirl system.

The outside surface of the guide wall 124 is provided with an abutment bead 1241 serving to co-operate with the inwardly-extending rim 1141 of the guide band 114. The guide wall 124 is disposed in the annular gap formed between the guide band 114 and the bushing 113. The abutment bead 1241 makes it possible to secure the pusher to the body, which can thus only move axially over a maximum stroke determined by the distance between the bottom end of the guide wall 124 and the end wall of the annular gap formed between the band 114 and the bushing 113.

In this embodiment, the piston member 130 comprises a main piston 136 engaged to slide in leaktight manner in the main cylinder 117, and a differential piston formed by two lips 132 and 133 in leaktight sliding contact in the cylinder formed by the inside surface 1232 of the dispensing wall 123. The piston member 130 is advantageously formed integrally as a single piece. The lips 132 and 133 extend one above the other with spacing greater than the axial extent of the swirl system 126. In the rest position, shown in FIG. 1, the top lip 132 is in contact with the inside surface 1232 above the swirl system 126, while the bottom lip 133 comes into contact with the inside surface 1232 below the swirl system 126. Thus, the swirl system cannot communicate with the inside of the pusher except at the space formed between the two lips 132 and 133. This is the rest position into which the piston member 130 is urged against the push wall 121 by the spring 140, which bears at one end against the shoulder 1131 and at the other end under a disk 131 formed by the piston member 130. In addition, the two lips 132 and 133 are formed on the outer periphery of the disk 131. At its center, the disk comes into abutment against the abutment stud 1213 formed at the inside surface 1212 of the push wall 121. It can be considered that the differential piston is formed by the disk 131 that forms the two lips 132 and 133. The piston member 130 also forms an axial central rod 137 that extends from the disk 131 away from the push wall 121. The axial rod 137 is engaged in part inside the inlet sleeve 116 formed by the body 110. The rod 137 forms a valve profile 138 serving to co-operate with the corresponding profile 1161 formed by the sleeve 116. In other words, the rod 137 in co-operation with the sleeve 116 forms an inlet valve for a pump chamber 1, as explained below. In addition, the piston member 130 forms a piston bushing 135 at the bottom end of which the main piston 136 is formed. The piston bushing 135 extends concentrically around the axial rod 137, so as to define between them an annular duct that extends through the disk 131 via fluid-passing holes 134.

The body 110, the pusher 120, and the piston member 130 together form a pump chamber 1 that extends continuously between the main cylinder 117 and the sleeve 116, between the piston bushing 135 and the axial rod 137, through the holes 134, and between the disk 131 and the inside surface 1212 of the push wall 121. Thus, the top surface of the disk 131 and the inside surface 1212 form wall elements for the pump chamber 1. In the rest position, shown in FIG. 1, the spring 140 pushes the piston member 130 into abutment against the push wall 121. The inlet valve formed by co-operation between the axial rod 137 and the sleeve 116 is open. The two lips 132 and 133 of the differential piston are in contact with the cylinder formed by the inside surface 1232 of the actuating wall 123 as shown in dashed lines in FIG. 3*a*.

When a force is exerted on the push outside surface 1211 of the push wall 121, the pusher is caused to move axially relative to the body 110. Since the piston member is in abutment against the push wall, the piston member is pushed by the pusher. In a first stage, movement of the pusher causes the inlet valve to be closed: the axial rod 137 is engaged more deeply into the sleeve 116 until leaktight sliding contact is achieved between the sleeve and the rod. Thus, the pump chamber 1 is isolated from the reservoir 5. As from then, the fluid in the pump chamber 1 is put under pressure. Because the fluid is incompressible, the total working volume of the pump chamber remains constant. But since the main piston 136 penetrates into the cylinder 117, thereby reducing the volume of the bottom portion of the chamber, a new volume must be created. This is made possible by the fact that the differential piston moves away from the push wall 121. This causes the lips 132 and 133 to slide inside the dispensing wall 123. The lips thus move until the top lip 132 reaches the swirl system 126. This is shown in FIG. 2. Whereupon, the fluid under pressure in the pump chamber finds an outlet passageway through the swirl system and through the dispensing orifice. The position of the top lip 132 is shown in dashed lines in FIG. 3*b*. The passageway thus remains open so long as the pressure inside the chamber can overcome the force of the spring 140. As soon as the pressure inside the chamber decreases below a certain threshold, the spring 140 pushes the differential piston back towards the rest position shown in FIG. 3*a*. The swirl system and the dispensing orifice are then isolated once again from the pump chamber.

It can be noted that the top lip 132 is directly in contact with the fluid, whereas the bottom lip is not directly in contact with the fluid. Thus, the top lip slides in the top portion of the cylinder defined between the push wall and the swirl system.

Said top portion offers a surface of quality better than the quality of the surface of the bottom portion that extends below the swirl system, which portion might be damaged by the molding core being removed.

Figure 3A:
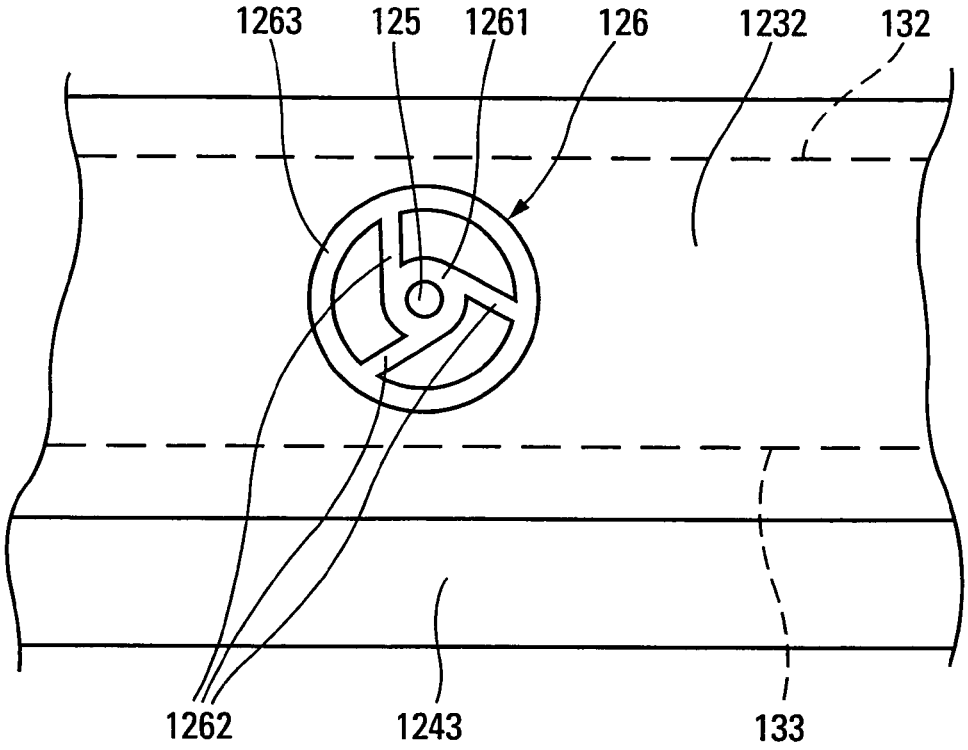
FIGS. 3*a* and 3*b* are diagrammatic views of the inside surface of the dispensing wall provided with a swirl system of the invention, respectively in the rest position and in the actuated position.
Figure 3B:
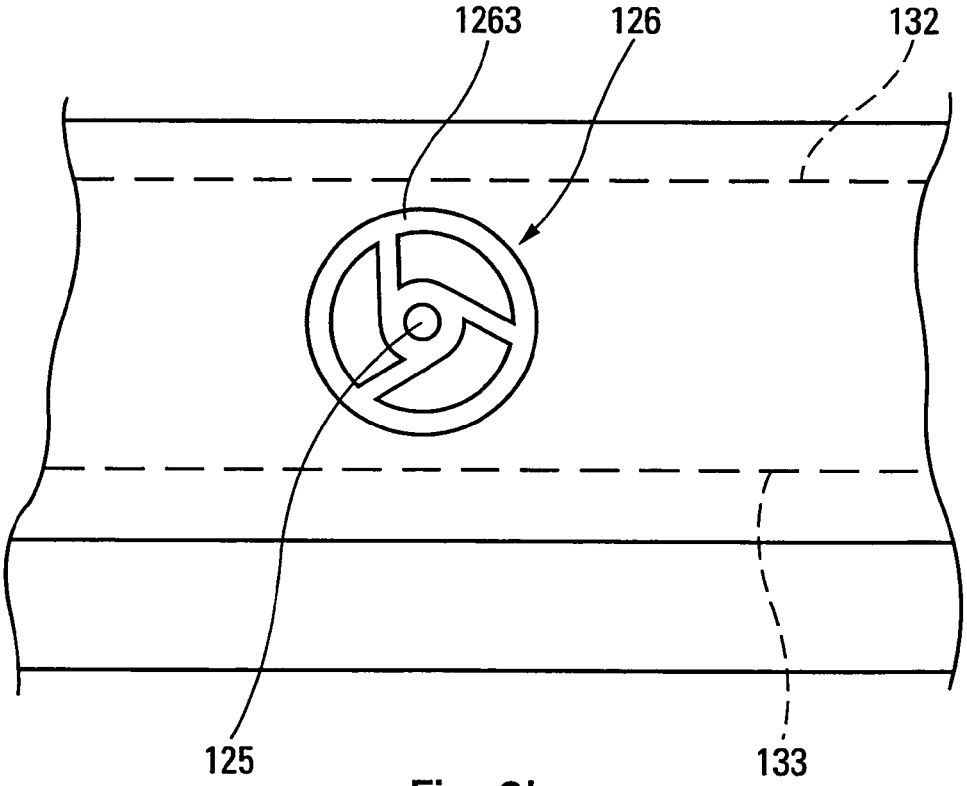

FIGS. 3*a* and 3*b* show a particular non-limiting embodiment for the swirl system formed in the dispensing wall of the dispensing member of the invention. Said swirl system comprises at least one tangential swirl channel 1262. In the figures, there are three tangential channels disposed at uniform angular spacing. The swirl system further comprises a central swirl chamber 1261 that is accurately centered relative to the dispensing orifice 125. Optionally, the swirl system may further comprise a peripheral feed ring 1263 which makes it possible to feed all of the swirl channels 1262. If necessary, the swirl system can be reduced to a single swirl channel associated with the central swirl chamber.

An advantageous characteristic of the invention lies in the fact that the piston member 140 is urged against the push wall 121 and moves under the effect of the increase in pressure inside the pump chamber away from said push wall. This is made possible in particular by means of the fluid-passing holes 134 provided through the disk 131 forming the differential piston. It is thus possible to say that the push wall defines a wall element of the pump chamber.

The differential piston moving away from the push wall in this way, in association with a swirl system formed in the dispensing wall is advantageous for the purposes of unmolding, given that the top lip 132 slides in leaktight manner over the top portion of the slide cylinder, which top portion cannot then be damaged by withdrawing the molding core forming the "negative" imprint that served to mold the swirl system.

It can also be noted that the rest position is reached when the abutment bead 1241 formed by the guide wall 124 is in abutment under the inwardly-extending rim 1141.

In addition, axial guiding of the pusher is guaranteed firstly by the guide wall 124 being guided axially between the band 114 and the bushing 113, and secondly by the piston bushing 135 and the axial rod 137 being engaged respectively in the main cylinder 117 and in the inlet sleeve 116.

Figure 4B:
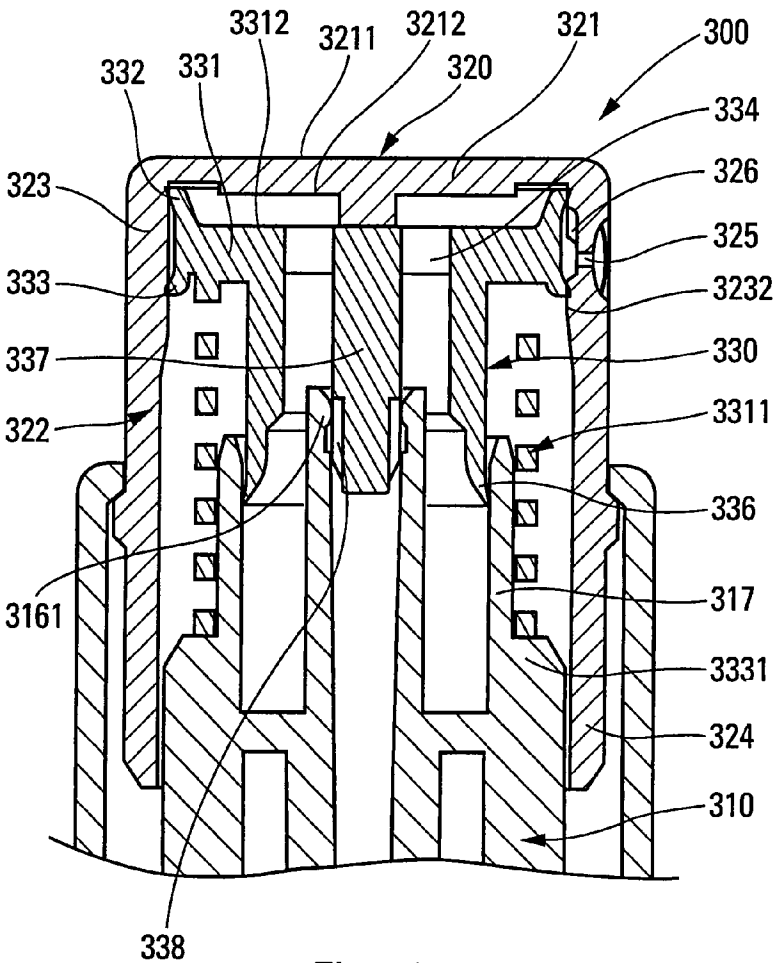
FIGS. 4*a* and 4*b* are vertical section views through respective ones of two variant embodiments of the dispenser member.
Figure 4A:
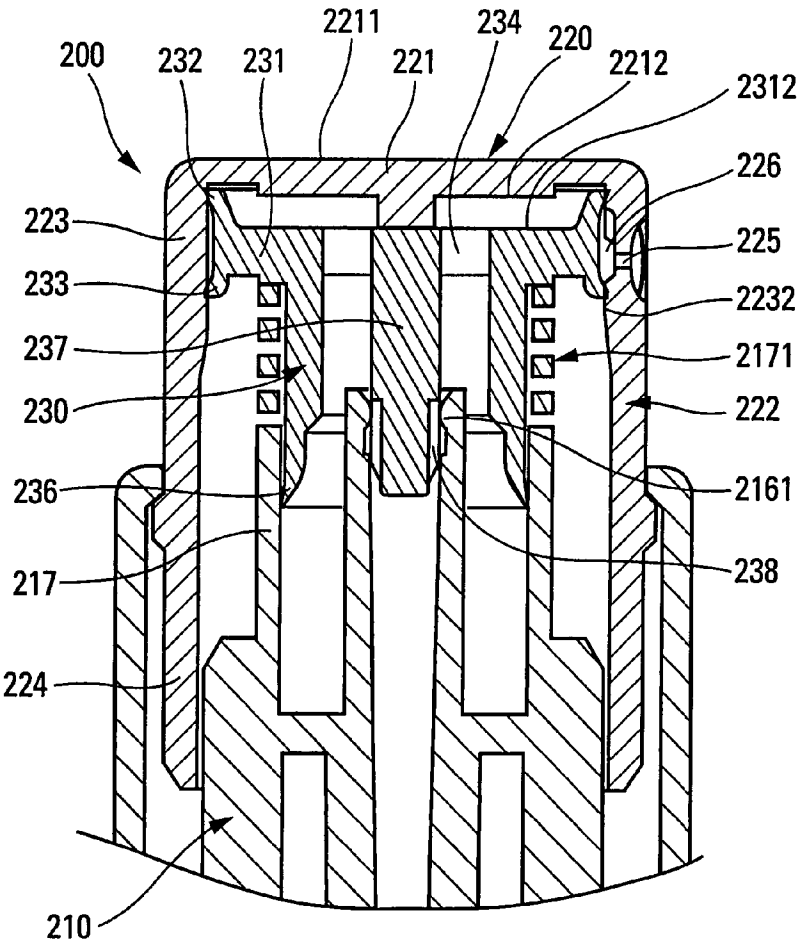

FIGS. 4*a* and 4*b* show respective variants of the embodiment of FIGS. 1 and 2.

In the variant shown in FIG. 4*a*, the return and precompression spring is formed integrally with the body 210 and bears the numerical reference 2171. The spring extends in alignment with the main cylinder 217 and comes into abutment under the disk 231 which forms the differential piston with its two lips 232 and 233. The spring 2171 thus extends concentrically about the bushing 230 that forms the main piston 236. Apart from the return spring, the dispenser member 200 of FIG. 4*a* can be identical to the dispenser member of FIGS. 1 and 2.

In the embodiment 4b, the dispenser member 300 includes a return spring 3311 which is formed integrally with the piston member 330. More precisely, the spring 3311 extends from the bottom face of the disk 331. It comes into abutment at its bottom end against the shoulder 3331 formed by the body 310. Apart from the particular form of the spring, the dispenser member 300 may be identical to the dispenser member of FIGS. 1 and 2.

In the variant embodiments of FIGS. 4*a* and 4*b*, the dispenser member comprises three component elements only, namely a body, a pusher, and a piston member, since the return and precompression spring is integral either with the body or with the piston member.

Figure 5:
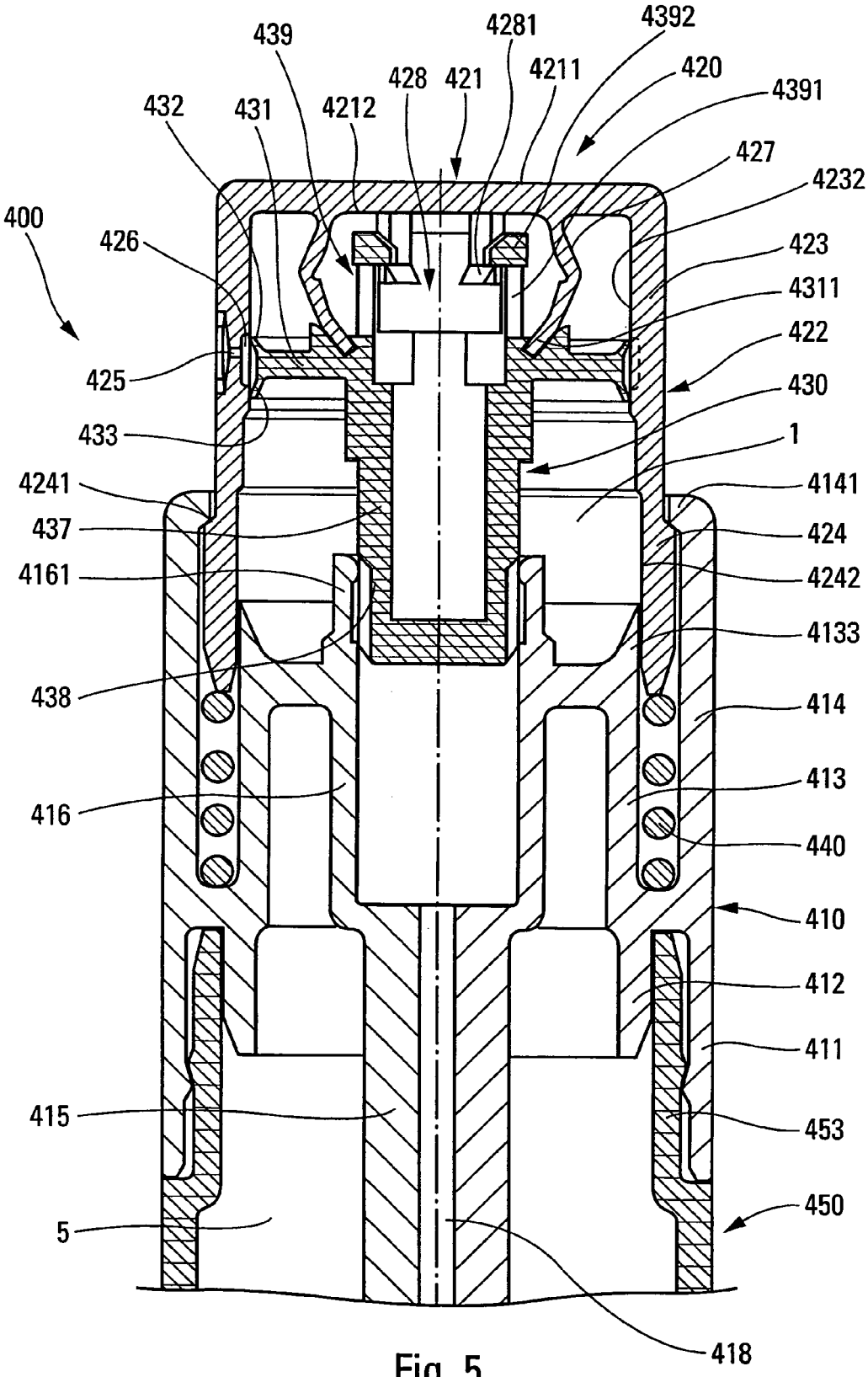
FIG. 5 is a vertical section view similar to the view of FIGS. 1 and 2, showing another embodiment of the invention, in the rest position.
Figure 6:
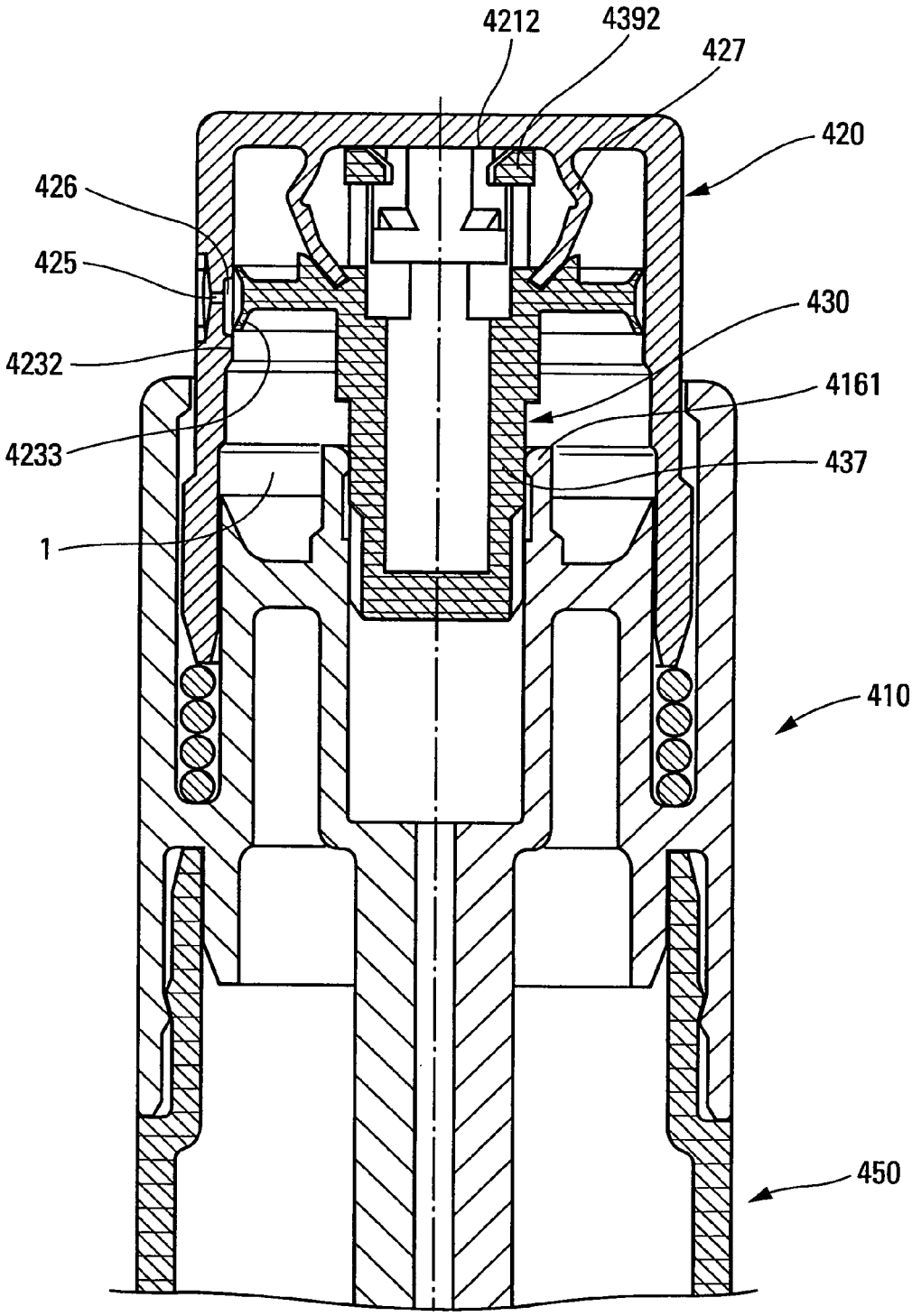
FIG. 6 is a view similar to FIG. 5, in the actuated position.

The embodiment of the dispenser member of the invention shown in FIGS. 5 and 6 is shown in association with a receptacle 450 defining an opening in the form of a neck 453 which advantageously has a fixing profile on its outside surface. The receptacle 450 internally defines a fluid reservoir 5.

The dispenser member designated overall by the numerical reference 400 comprises three component elements, namely a body 410, a pusher 420, and a piston member 430. All three parts can be made of a plastics material by injection molding.

The body 410 has a fixing ring 411 that co-operates with the neck 453 of the receptacle 450. More precisely, the ring 411 comes into engagement around the neck 453. The body 410 can also be provided with a self-sealing lip 412 in sealing contact with the inside wall of the neck 453. A guide band 414 can extend in alignment with the fixing ring 411. At its top end, the ring 414 is provided with an inwardly-extending rim 4141 whose function is given below. The body 410 is also provided with a bushing 413 which extends concentrically inside the guide band 414. Thus, an annular space is created between the band 414 and the bushing 413. The top end of the bushing 413 forms a main piston 4133 in the form of a sealing lip. The body 410 is also provided with a inlet sleeve 416 which extends concentrically inside the bushing 413. The top end of the sleeve 416 forms a valve profile or seat 4161. In addition, the body 410 integrally forms a dip tube 415 which extends into the receptacle 450. The dip tube internally defines an inlet duct 418 which extends to inside the inlet sleeve 416.

The pusher 420 has a push wall 421 and a peripheral skirt 422. The skirt 422 is connected to the push wall 420 at its outer periphery. The push wall 421 has a push outside surface 4211 and an inside surface 4212. The push wall 421 and the skirt 422 are in the general shape of an upside-down cup with the end-wall of the cup formed by the push wall 421 and the cylindrical side wall formed by the skirt 422. The push wall 421 is provided with spring means in the form of elastically deformable tabs or blades 427 which extend from the inside surface 4212. In addition, the push wall 421 is provided with a retaining member 428 which also extends from the inside surface 4212. The retaining member 428 is provided with at least one retaining profile 4281 having a retaining edge facing the inside surface 4212. In practice, the retaining member can be provided with a plurality of retaining profiles formed on the outside of a column extending downwards from the push wall 421.

The skirt 422 is provided with a dispensing wall 423 and with a guide wall 424.

The dispensing wall 423 is connected via its top end to the outer periphery of the push wall 421. The guide wall 424 is connected via its top end to the bottom end of the dispensing wall 423. The dispensing wall 423 is provided with an outside surface and with an inside surface 4232. The inside surface is cylindrical at least in part so as to constitute a leaktight slide cylinder. The inside wall 4232 is advantageously provided with a swirl system 426 which forms a recessed network in the cylindrical surface 4232. This swirl system can comprise one or more swirl channels and a swirl chamber. In addition, the dispensing wall 423 is provided with a dispensing orifice which passes through the wall so as to extend from the inside surface to the outside surface. The dispensing orifice 425 is centered relative to the swirl system 426. The swirl system can be identical to the swirl system shown in FIGS. 3*a* and 3*b*.

The guide wall 424 is engaged in the annular space formed between the guide band 414 and the bushing 413. The guide wall forms a shoulder 4241 serving to come into abutment under the inwardly-extending rim 4141 of the band 414. Advantageously, the inside surface 4242 of the guide wall 424 forms a main cylinder inside which the main piston 4133 can be moved in leaktight contact. The guide wall 424 is urged by a spring 440 which pushes the shoulder 4241 against the inwardly-extending rim 4141. The spring 440 can advantageously be formed integrally with the pusher in alignment with the guide wall 424. Thus, the main piston 4133 can slide inside the pusher, or more precisely inside the guide wall 424 which internally forms the main cylinder 4242.

In this example, the piston member 430 forms a differential piston associated with a moving inlet valve member. The piston member 430 has a disk 431 which, at its outer periphery, forms two sealing lips 432 and 433. The disk 431 and its two lips together form the differential piston. In the rest position shown in FIG. 5, the top lip 432 is positioned above the swirl system, whereas the bottom lip 433 is positioned below the swirl system. Thus, the swirl system cannot communicate with the inside of the pusher. In addition, the disk 431 forms an annular recess 4311 serving to receive the free ends of the elastically deformable tabs 427 formed by the push wall 421. Furthermore, the piston member 430 forms a fastening element 439 which extends from the disk 431 towards the push wall 421. Said fastening element 439 is provided with fastening heads 4392 situated at the ends of tabs 4391. The fastening heads 4392 are in engagement between the inside wall 4212 and the retaining profiles 4281 formed by the retaining member 428. Thus, the heads can move over a limited stroke between the retaining profiles and the inside surface of the push wall. However, the elastically deformable tabs 427 urge the piston member 430 away from the push wall 421, so that the fastening heads 4392 are pushed into engagement with the retaining profiles 4281. The fastening heads 4392 can be caused to come into contact against the inside surface 4212 by flexing the elastically deformable tabs 427. Stroke-limiting means thus exist that are constituted by the retaining member co-operating with the fastening element.

The piston member 430 is thus held captive inside the pusher while being capable of moving axially over a limited stroke. However, the elastically deformable tabs 427 urge the piston member into the rest position, in which the fastening heads are in engagement with the retaining profiles. In addition, the sealing lips 432 and 433 are positioned on either side of the swirl system so as to isolate it. This corresponds to the rest position shown in FIG. 5.

In addition, the piston member 430 also forms an axial central rod 437 which, at its bottom end, has an inlet valve profile 438 which co-operates with the corresponding profile 4161 in the sleeve 416 to form the inlet valve therewith. In the rest position, the inlet valve is open.

Thus, a pump chamber 1 is created between the body, the pusher, and the piston member. The pump chamber 1 is isolated from the outside by the bottom lip 433 but it communicates with the reservoir through the open inlet valve.

Starting from the rest position shown in FIG. 5, it is possible to exert pressure on the push outside surface 4211 of the push wall 421. This causes the pusher and the piston member to move relative to the body. In a first stage, the inlet valve is closed due to the axial rod 437 penetrating more deeply into the sleeve 416 so as to establish sliding leaktight contact. Whereupon, the pump chamber 1 is isolated from the outside. The fluid in the pump chamber is then subjected to an increase in pressure, which causes the piston member 430 to move towards the push wall 421, against the spring force exerted by the resilient tabs 427. Thus, the bottom lip 433 moves upwards until it reaches the swirl system 426. Whereupon, the fluid finds an outlet passageway through the swirl system and through the dispensing orifice. This actuation position is shown in FIG. 6. In order to reach this position, it is necessary for the pressure inside the pump chamber to be greater than the stiffness of the elastically deformable tabs 427, which therefore act as a precompression spring. The piston member 430 can move towards the push wall 421 until the fastening heads 4392 come into abutment against the inside surface 4212. In this position, which is shown in FIG. 6, the bottom sealing lip 433 of the differential piston is positioned at the swirl system. As soon as the pressure inside the chamber decreases again, the piston member 430 can, once again, move away from the push wall 421 under the drive from the resilient tabs 427. Finally, the piston member 430 returns to its rest position shown in FIG. 5.

The piston member 430 is held captive inside the pusher while being allowed a limited degree of freedom to move axially. It should also be noted that the precompression spring is formed integrally with the pusher. In addition, the piston member being held captive, and its movement being limited are achieved entirely by the pusher and by the piston member, without any additional part being necessary.

Figure 7:
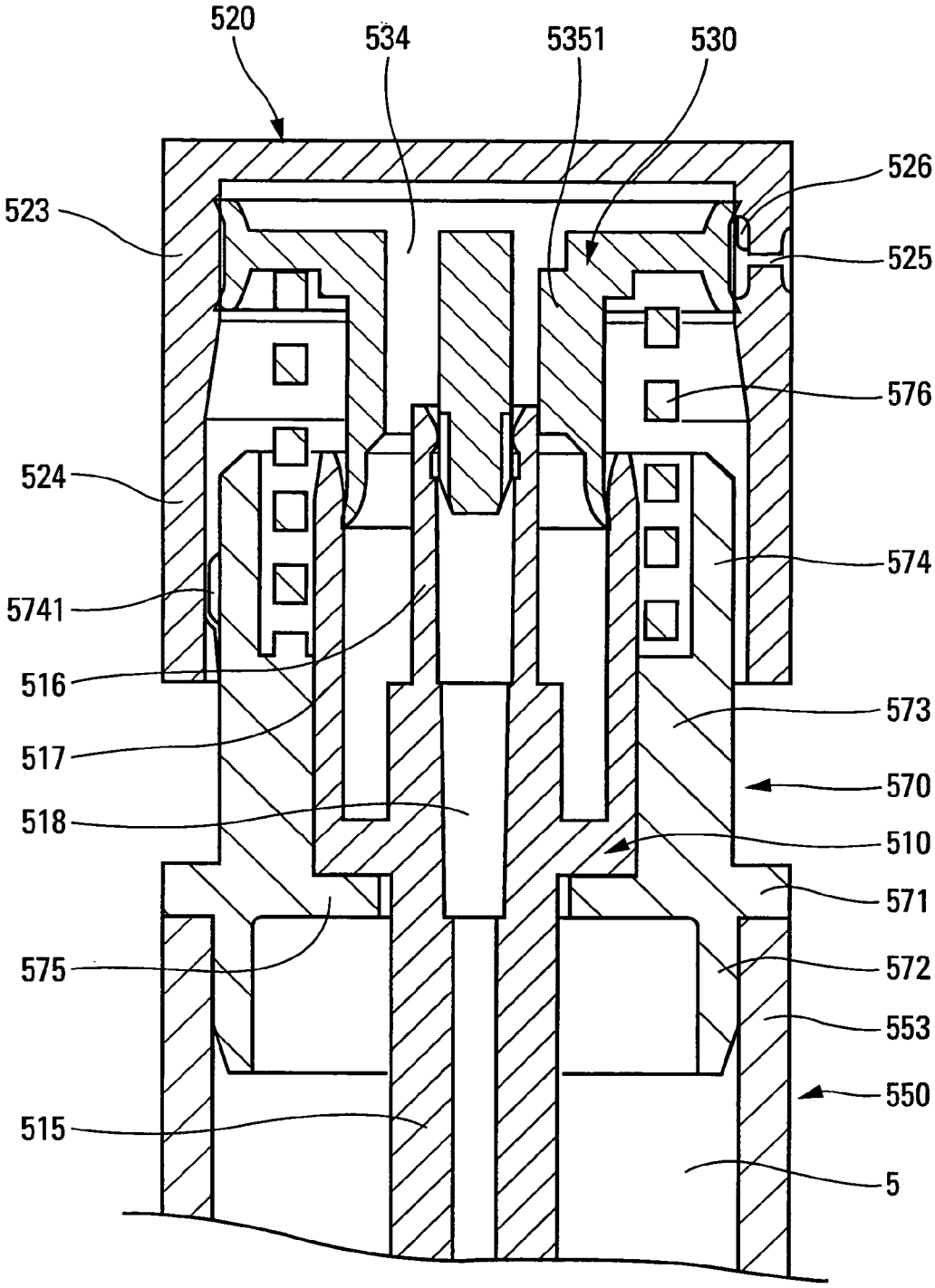
FIG. 7 is a vertical section view through yet another embodiment of the dispenser member of the invention, in the rest position.

In the embodiment shown in FIG. 7, the dispensing member comprises a body 510, a pusher 520, a piston member 530, and a fixing ring 570. The dispensing member is mounted on a receptacle 550 which internally forms a reservoir 5 and which is provided with an opening in the form of a neck 553 not provided with fixing profiles.

A difference relative to the embodiments of the preceding figures lies in the fact that the body no longer performs the fixing to the opening in the reservoir. Rather, in this embodiment, the body 510 is engaged in a fixing ring 570 which performs leaktight connection to the reservoir opening. For this purpose, the fixing ring 570 is provided with a self-sealing lip 572 engaged by force and in leaktight manner into the opening 553 in the receptacle 550. The ring 570 is provided with an abutment collar 571 in abutment against the top end of the opening 553. In addition, the body forms an inwardly-extending flange 575 which defines an opening for passing the dip tube 515 of the body 510. The ring 570 is further provided with a bushing 573 which internally defines a recess for the body 510. The bushing 573 is extended at its top end by a guide band 574. In addition, the ring 570 also forms a return and precompression spring 576 which extends in integral manner from the bushing 573 and concentrically inside the guide band 574. On its outside surface, the guide band 574 also forms an abutment profile 5741 which co-operates with the pusher 520.

The body 510 is engaged into the ring 570 or more precisely into the bushing 573 by coming into abutment against the inwardly-extending flange 575. As in the preceding other embodiments, the body 510 forms a slide cylinder 517, a dip tube 515, and an inlet sleeve 516.

The advantage of implementing the body and the ring in two separate distinct parts lies in the fact that it is possible to use different materials for the body and for the ring. This is justified in particular because the ring is often a decorative element whereas the body is a functional element. If, for example, the ring is to be made of a colored plastics material, the dip tube must not be made of the same material because it is very often visible through the receptacle. In addition, it is easier to make the spring 576 with the ring 570 when the body is made separately.

The piston member 530 can be strictly identical to the piston member of the preceding embodiments shown in FIGS. 1 to 4. However, it can be observed that the piston member 530 is provided with a guide rib 5351 designed to slide in non-leaktight manner around the sleeve 516.

As in the embodiments shown in FIGS. 1 to 4, the piston member forms a differential piston and a main piston. The differential piston slides in the pusher 520 whereas the main piston slides in the sleeve 517. The piston member 530 is designed to move away from the push wall of the pusher when the pressure increases. This causes a spray orifice 525 to be unmasked that is advantageously equipped with a swirl system 526 which is provided in the inside surface of the guide wall 523. It can also be observed that the bottom end of the pusher comes into abutting engagement against the abutment profile 5741. The outside diameter of the pusher is substantially identical to the outside diameter of the receptacle. In this way, the fixing ring 570 is visible only to a very small extent.

The invention claimed is:

1. A fluid dispenser member having a dispensing wall defining an outside surface and inside surface, said wall being provided with a through dispensing orifice connecting the inside surface to the outside surface, the inside surface forming a leaktight slide cylinder for a piston suitable for moving in leaktight contact inside said cylinder for selectively unmasking the dispensing orifice, said piston forming a wall element of a fluid chamber inside which fluid is selectively put under pressure; the inside surface, at the slide cylinder, forming a fluid swirl system immediately upstream from the dispensing orifice, wherein the dispensing wall is formed by a substantially cylindrical skirt further provided with a guide wall defining an inside surface whose inside diameter is greater than the inside diameter of the slide cylinder; and wherein the slide cylinder, the dispensing orifice and the swirl system are formed integrally with the dispensing wall.

2. A fluid dispenser member according to claim 1, in which the dispensing wall is formed by a pusher having a push wall which is extended at its outer periphery by the dispensing wall.

3. A fluid dispenser member according to claim 2, in which the piston is urged resiliently against the push wall, and can be moved away from said push wall in order to unmask the dispensing orifice.

4. A fluid dispenser member according to claim 1, in which the piston is urged resiliently away from the guide wall and can be moved towards said guide wall.

5. A fluid dispenser member according to claim 2, in which the piston is urged resiliently away from the push wall and can be moved towards said push wall.

6. A fluid dispenser member according to claim 3, in which the push wall is provided with an inside surface which forms a wall element of the chamber.

7. A fluid dispenser member according to claim 1, having a body serving to be associated with a fluid reservoir, said body forming a main cylinder in which a main piston slides.

8. A fluid dispenser member according to claim 1, in which the dispensing wall is formed by a substantially cylindrical skirt which further forms a guide wall defining an inside surface forming a main cylinder for a main piston.

9. A fluid dispenser member according to claim 1, in which the swirl system comprises at least one swirl channel and a swirl chamber centered on the dispensing orifice and optionally a peripheral feed ring.

10. A fluid dispenser member according to claim 1, in which the swirl system forms a network that is recessed relative to the substantially cylindrical inside surface of the dispensing wall.

11. The fluid dispenser member according to claim 1, wherein the inside surface of the guide wall is not in leaktight contact with an opposing surface.

12. The fluid dispenser member according to claim 1, wherein the swirl system is formed as a one-piece integral construct with the dispensing wall.

13. A fluid dispenser member having a dispensing wall defining an outside surface and inside surface, said wall being provided with a through dispensing orifice connecting the inside surface to the outside surface, the inside surface forming a leaktight slide cylinder for a piston suitable for moving in leaktight contact inside said cylinder for selectively unmasking the dispensing orifice, said piston forming a wall element of a fluid chamber inside which fluid is selectively put under pressure; the inside surface, at the slide cylinder, forming a fluid swirl system immediately upstream from the dispensing orifice, wherein the dispensing wall is formed by a substantially cylindrical skirt further provided with a guide wall defining an inside surface whose inside diameter is greater than the inside diameter of the slide cylinder; and wherein the piston is a differential piston which moves in response to variation in the pressure in the chamber, said differential piston having at least one sealing lip in leaktight sliding contact with the slide cylinder.

14. A fluid dispenser member according to claim 13, in which the differential piston is integral with or secured to a main piston in leaktight sliding contact in a main cylinder.

15. The fluid dispenser member according to claim 13, wherein the inside surface of the guide wall is not in leaktight contact with the differential piston.

16. A fluid dispenser member, comprising:

a piston; and a dispensing wall defining an outside surface and inside surface, the wall comprising a dispensing through hole communicating the inside surface to the outside surface;

wherein the inside surface of the wall comprises a leaktight slide cylinder for the piston, the piston moveable in leaktight manner inside the cylinder for selectively unmasking the dispensing orifice;

wherein the piston forms a wall element of a fluid chamber inside which fluid is selectively put under pressure;

wherein the dispensing wall comprises a fluid swirl channel immediately upstream from the dispensing orifice, the fluid swirl channel formed in the inside surface at the slide cylinder;

wherein the dispensing wall is formed by a substantially cylindrical skirt comprising a guide wall defining an inside surface whose inside diameter is greater than the inside diameter of the slide cylinder; and wherein the slide cylinder, the dispensing orifice and the swirl channel are formed as a one-piece integral construction with the dispensing wall.

17. The fluid dispenser member according to claim 16, wherein the inside surface of the guide wall is not in leaktight contact with an opposing surface.

* * * * *